United States Patent [19]

Fujita

[11] Patent Number: 4,984,398

[45] Date of Patent: Jan. 15, 1991

[54] FOLDING STAGE UNIT

[76] Inventor: Kazuo Fujita, No. 1, Hagiyamadai 1-chome, Seto, Aichi, Japan

[21] Appl. No.: 505,186

[22] Filed: Apr. 5, 1990

Related U.S. Application Data

[62] Division of Ser. No. 315,847, Feb. 27, 1989, Pat. No. 4,939,875.

[30] Foreign Application Priority Data

Aug. 27, 1988 [JP] Japan ..... 63-213417

[51] Int. Cl.[5] ..... E04H 3/26

[52] U.S. Cl. ..... 52/7

[58] Field of Search ..... 52/7, 10; 108/6, 7, 108/8, 9

[56] References Cited

FOREIGN PATENT DOCUMENTS

| | | |
|---|---|---|
| 454610 | 11/1098 | Japan . |
| 454610 | 8/1977 | Japan . |
| 53-26245 | 7/1978 | Japan . |
| 454610 | 5/1980 | Japan . |
| 532496 | 5/1980 | Japan . |
| 56-28973 | 3/1981 | Japan . |
| 60-12092 | 1/1985 | Japan . |
| 60-44959 | 3/1985 | Japan . |
| 60-25482 | 7/1985 | Japan . |
| 61-1769 | 1/1986 | Japan . |
| 61-16200 | 1/1986 | Japan . |
| 62-34059 | 2/1987 | Japan . |
| 62-160371 | 7/1987 | Japan . |
| 62-187047 | 11/1987 | Japan . |
| 63-304878 | 12/1988 | Japan . |
| 1-105875 | 4/1989 | Japan . |

*Primary Examiner*—John E. Murtagh

*Attorney, Agent, or Firm*—Fred Philpitt

[57] ABSTRACT

A folding stage unit comprises a guide post and a stage proper. The guide post may be fixed to an indoor or outdoor support wall structure. An inner space of the guide post is generally divided into an inner chamber and outer chambers. Vertical grooves are provided in opposed side walls of the guide post, and make the outer chambers communicate with the outside of the guide post. A pair of vertically-movable supports are provided in the respective outer chambers. A vertically-movable balancer is located in the inner chamber. Mechanisms are provided in the inner space for connecting the supports and the balancer for opposite vertical movements. The stage proper includes a platform, a platform supporting structure with plural support legs which are pivotally connected to the bottom of the platform, and wheels provided in conjunction with respective foremost support legs to enable a front end portion of the stage proper to move smoothly toward or away from the guide post on a floor. Mechanisms provided for connecting a rear portion of the platform supporting structure to the supports through the grooves so that a rear portion of the stage proper can be moved along the guide post. A pair of opposed operating mechanisms are connected to the platform supporting structure for folding the stage proper from a horizontal position on the floor to a vertical position adjacent to the guide post or unfolding the stage proper from the vertical position to the horizontal position. Each operating mechanism includes a geared motor and an extensible swing arm member.

2 Claims, 6 Drawing Sheets

FOLDING STAGE UNIT

REFERENCE TO RELATED APPLICATION

The present application is a division of U.S. patent application Ser. No. 315,847 filed Feb. 27, 1989 now U.S. Pat. No. 4,739,875.

FIELD OF THE INVENTION

This invention relates to a folding stage unit, especially adapted to be used for a full-size folding stage system.

BACKGROUND OF THE INVENTION

A typical folding stage system of the prior art is proposed in Japanese Application for Registration of Utility Model No. 52-82315 (published under No. 60-25482). The prior folding stage system has a guide post to be fixed to a wall or the like, and a balancer mechanism supporting the rear portion of the stage body for vertical movement. The prior folding stage system also has, on its front portion, wheels to enable the stage body to be moved on a floor. The stage body of the system can be "folded" or stored from a horizontal position on the floor to a vertical position adjacent to the post. Legs are pivotally connected to the bottom of a platform so that the legs make right angles with the platform when supporting the platform on the floor, but change their angles to the platform as the legs are raised away from the floor when the stage body is moved to the vertical position, and become parallel to the platform when the platform is moved to a vertical position.

The inventor hereof proposed a folding stage system similar to the foregoing one in Japanese Application for Registration of Utility Model No. 59-100829 (published under No. 61-16200).

Although with the help of the balancer mechanism, either of the prior folding stage systems must be manually folded or unfolded and, hence, are not suitable for use as a stage unit of a full-size folding stage system with a proscenium wall. It is necessary to use electrically-operated stage units to produce such a full-size stage system which can be folded and unfolded without labor. Thus, the inventor hereof proposed an electrically-operated (, or electrically folded and unfolded ) stage unit for such a full-size stage system in Japanese Patent Applications No. 59-120395 (published Jan. 7, 1986 under No. 61-1769). The inventor also proposed such an electrically-operated stage unit in Japanese Patent Application No. 60-298461 (published July 16, 1987 under No. 62-160371).

However, the stage proper of a stage unit used for a folding stage system of FIG. 5 of Japanese Patent Application No. 59-120395 is folded (, or moved to a vertical position) and unfolded (, or moved to a horizontal position on a floor) not only by a first operating mechanism, but also with the help of a second operating mechanism which is chiefly used to move the proscenium wall. It is also the case with the stage unit of Japanese Patent Application No. 60-298461.

SUMMARY OF THE INVENTION

Accordingly, it is an object of the invention to provide a stage unit, especially adapted to be used for a full-size folding stage system, which has a single operating mechanism for folding and unfolding a stage proper.

According to the invention, a folding stage unit is provided which includes a guide post and a stage proper. The guide post may be fixed to an indoor or outdoor support wall structure. The guide post has an inner space generally divided into an inner chamber and outer chambers. Vertical grooves are provided in opposed side walls of the guide post, and make the outer chambers communicate with the outside of the guide post. A pair of vertically-movable support means are provided in the respective outer chambers. A vertically-movable balancer is located in the inner chamber. Means are provided in the inner space for connecting the support means and the balancer for opposite vertical movements. The stage proper includes a platform, a platform supporting structure with plural support legs which are pivotally connected to the bottom of the platform, and wheels provided in conjunction with respective foremost support legs to enable a front end portion of the stage proper to move smoothly toward or away from the guide post on a floor. Means are provided for connecting a rear portion of the platform supporting structure to the support means in the guide post through the grooves thereof so that a rear portion of the stage proper can be moved along the guide post. A pair of opposed operating mechanisms are connected to the platform supporting structure for folding the stage proper from a horizontal position on the floor to a vertical position adjacent to the guide post or unfolding the stage proper from the vertical position to the horizontal position. Each operating mechanism includes a geared motor fixed to the platform supporting structure at a substantial middle of the distance between front and rear ends of the stage proper and having an output shaft rotatable in either of opposed directions and an extensible swing arm member having one end fixed to the output shaft and an opposed end pivotally connected to a portion chosen between a portion of the floor which is in close proximity to the support wall structure and a lower end portion on the support wall structure. The swing arm member may comprise a pair of elongate hollow members and rods having free end portions received in the respective elongate members in such a manner that the free end portions may slide along the lengths of the respective elongate members.

BRIEF DESCRIPTION OF THE DRAWING

In FIG. 2 the stage unit is depicted in its longitudinal section;

FIG. 4 depicts an outermost guide post and a central guide post as a single continuous member for convenience sake, FIG. 4 is a partially imaginary view;

DETAILED DESCRIPTION OF PREFERRED EMBODIMENT

Figure 1:
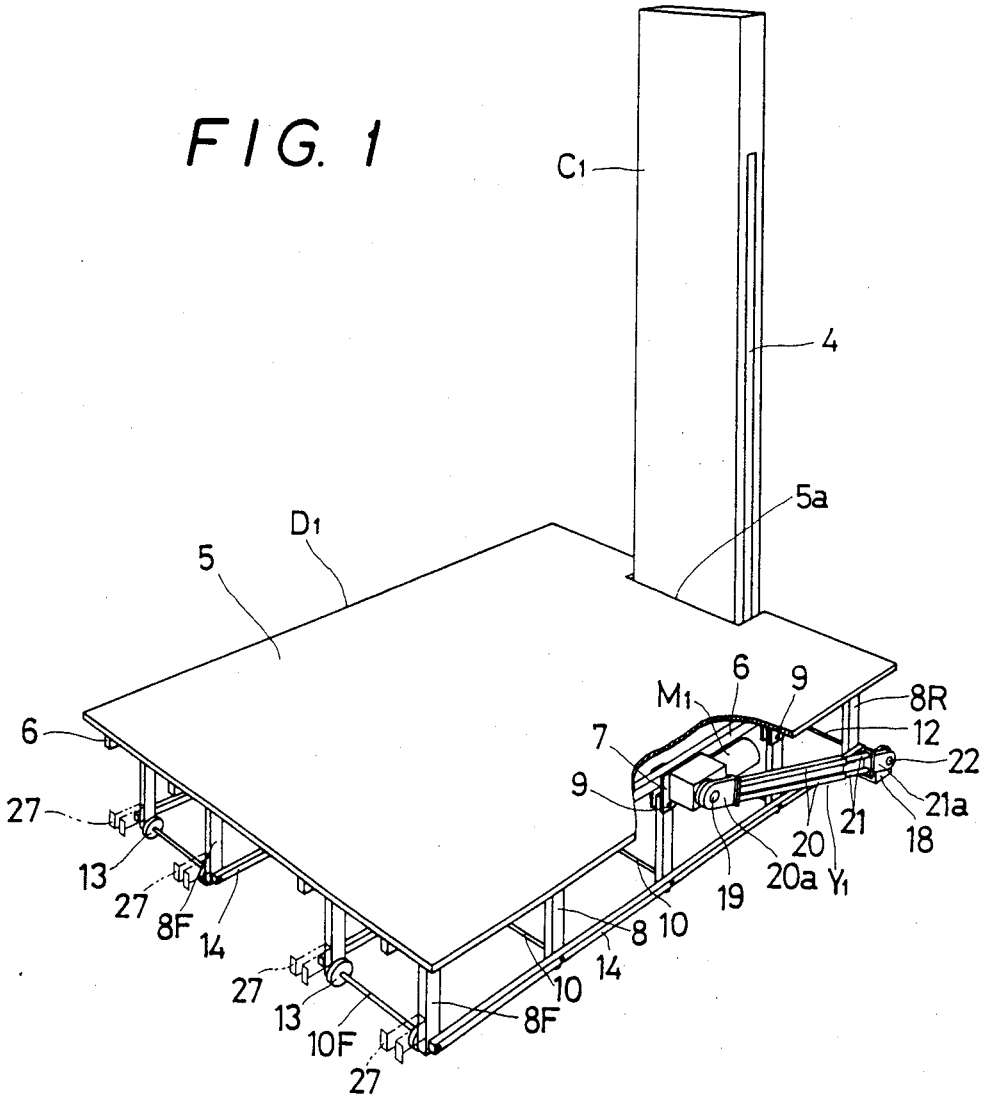
FIG. 1 is a partially cutaway perspective view of a folding stage unit according to the invention.

A stage unit according to the invention will now be described in detail with reference to the drawing.

Figure 2:
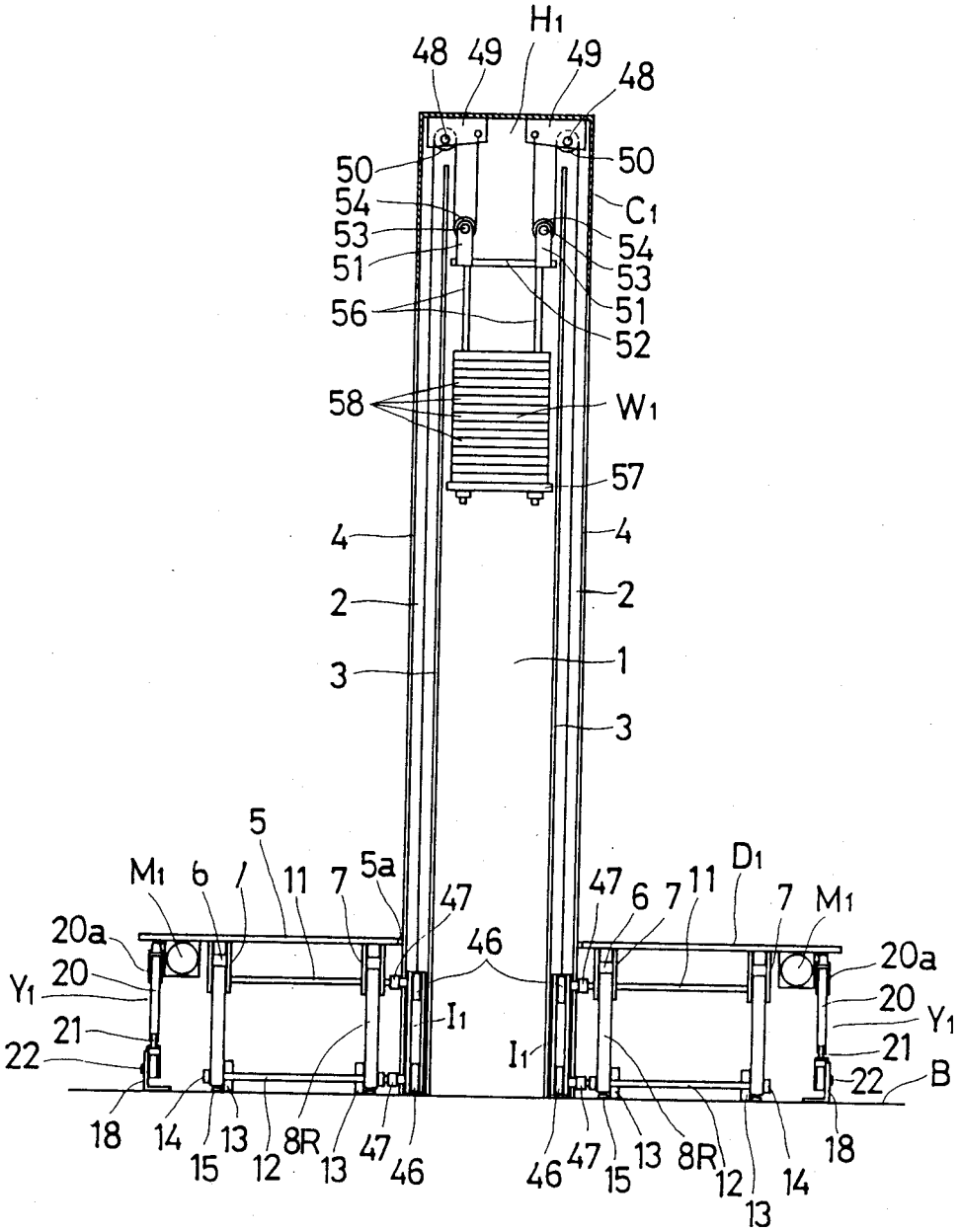
FIG. 2 is a rear elevation of the stage unit of FIG. 1.

The stage unit is best shown in FIGS. 1 and 2. The stage unit comprises a guide post $C_1$ and a stage proper $D_1$.

The guide post $C_1$ includes an enclosing wall which defines an inner space. The inner space is generally divided into an inner large chamber 1 and outer small chambers 2 by a pair of opposed vertical partition walls 3. A balancer $H_1$ is provided in the inner space. The construction of the balancer is illustrated in more detail in FIG. 4 of the drawing of Japanese Patent Application No. 60-298461. A pair of vertically-movable rectangular support pieces $I_1$ are located in the outer chambers 2, respectively. A pair of vertical guide grooves 4 are formed in the side walls of the guide post. The grooves 4 extend through the entire thicknesses of the side walls.

Figure 4:
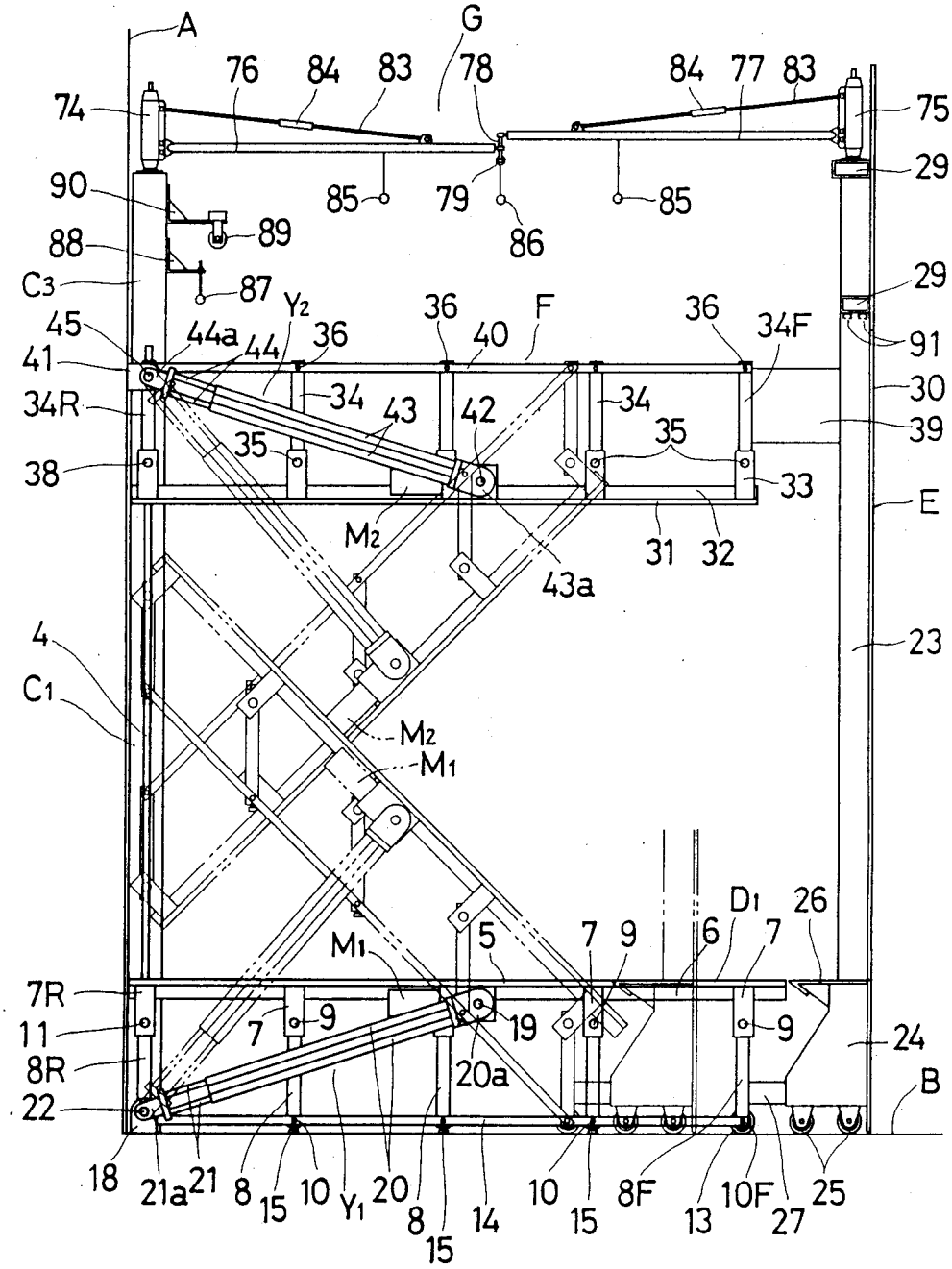
FIG. 4 is a side view of the stage system of FIG. 3. Since

The stage proper $D_1$ includes a platform 5 with a recess 5a at the rear end portion thereof. The guide post $C_1$ extends through the recess 5a. Two pairs of beams 6 are fixed to the bottom of the platform 5. Five support legs 8F, 8 and 8R are connected to each beam 6 by means of connecting members 7 and 7R. The connecting members 7R (FIG. 4) are rearmost connecting members which connect the rearmost support leg 8R to the beam 6. The foremost support leg 8F and the three middle support legs 8 are connected to the associated connecting members 7 by means of pivotal pins 9. The rearmost support leg 8R is connected to the associated connecting members 7R by means of a pivotal rod 11 (FIGS. 2 and 4). This rod 11 not merely connects the support leg 8R to the connecting members 7R, but also extends towards the guide post $C_1$ and connects the opposed, partnered rearmost support leg 8R to the connecting members 7R associated therewith and further extends towards the guide post $C_1$ and is fixedly received by a rod support 47 which projects outwardly from the outer surface of the support piece $I_1$ located in one of the opposed outer chambers 2 of the guide post. Thus the rod 11 also connects the opposed rearmost legs 8R to each other.

Also, all the support legs connected to the beam 6 are connected at the lower portions thereof to the opposed support legs which are connected to the opposed partnered beam 6, by means of rods. The rod connecting the opposed foremost support legs 8F is designated by reference numeral 10F. The rods connecting the opposed middle support legs 8 are designated by reference numeral 10. The rod connecting the opposed rearmost support legs 8R is designated by reference numeral 12. The opposed end portions of each rod (10 or 12) extend through and project from the associated opposed support legs, and connect lower opposed beams 14 pivotally to the opposed rows of the support legs. Like the upper rearmost rod 11, the lower rearmost rod 12 is fixedly received at the inner end thereof by a rod support 47 which projects outwardly from the outer surface of the support piece $I_1$.

A wheel 13 is provided in conjunction with each foremost support leg 8F. The wheel 13 is located inwardly of the support leg 8F, and is mounted on the foremost rod 10F. The wheel 13 is formed of hard rubber at the circumference thereof, and enables the stage proper $D_1$ to move smoothly on a floor B. No wheel is provided in conjunction with the three middle support legs 8 and the rearmost support leg 8R. Instead, a base member 15 is provided in conjunction with each of these support legs 8 and R. The base member 15 is connected to the bottom of the support leg. Thus the support legs 8 and 8R rest on the floor B through the base members 15. Thanks to the presence of the base members 15 the heights of the support legs 8 and 8R from the floor B are the same as the heights of the foremost support legs F from the floor B.

A pair of geared motors $M_1$ are connected to the bottom of the platform 5. Each geared motor $M_1$ is rotatable in either of opposed directions. One of the geared motors $M_1$ is located by the side of one of the upper outermost beams 6. The other geared motor $M_1$ is located by the side of the other upper outermost beam 6. Each motor $M_1$ has an outwardly-projecting output shaft 19. The shaft 19 has a torque limiter (not shown) therein. Reference numeral 20 designates a pair of elongate, hollow rectangular members which are formed integrally with each other. The elongate members 20 are connected to the output shaft 19 by means of a connecting means 20a which is fixed to the shaft 19. A pair of rods 21 are received in the respective elongate members 20. One end of each rod 21 is fixed to a connecting means 21a. The connecting means 21a is connected to a support means 18 by a pivot 22. The support means 18 is fixed to the floor B, and is located in close proximity to the wall A (FIG. 4). If desired, however, the support means 18 may be fixed to the lower end of the wall A instead of the floor B.

Each rod 21 has a free end in the associated elongate member 20, and is slidable therein along the length thereof.

The elongate members 20 and the slidable rods 21 constitute a swing arm member $Y_1$. The motors $M_1$ and the swing arm members $Y_1$ in turn constitute a single mechanism for moving the stage proper $D_1$ on the floor B, or folding it to an upright position (FIG. 5) which is immediately in front of the guide post $C_1$ or unfolding it to the horizontal position of FIG. 3.

When the foregoing stage folding mechanism folds or unfolds the stage proper, the rods 21 slide in the respective elongate members 20 and, thus, the distance between the motor shaft 19 and the pivot 22 is varied.

The support pieces designated by $I_1$. The support pieces in the side guide post $C_2$ are designated by $I_2$. The support pieces in the outermost guide post $C_3$are designated by $I_3$.

A pair of front and rear guide rollers 46 are provided above each support piece $I_1$ and likewise a pair of front and rear guide rollers 46 are provided below each support piece $I_1$ The front rollers 46 roll on and along the inner surface of the front wall of the guide post while the rear rollers 46 roll on and along the inner surface of the rear wall of the guide post. Thus the rollers 46 facilitates the vertical movements of the support pieces in and along the outer chambers 2 of the guide post.

The previously-mentioned rod supports 47 project outwardly from the outer surface of each support piece through the guide groove 4 of the guide post. As mentioned before, the rod supports 47 fixedly support the inner end portions of the upper and lower rods connecting the opposed rearmost support legs of the stage proper to each other.

Figure 7:
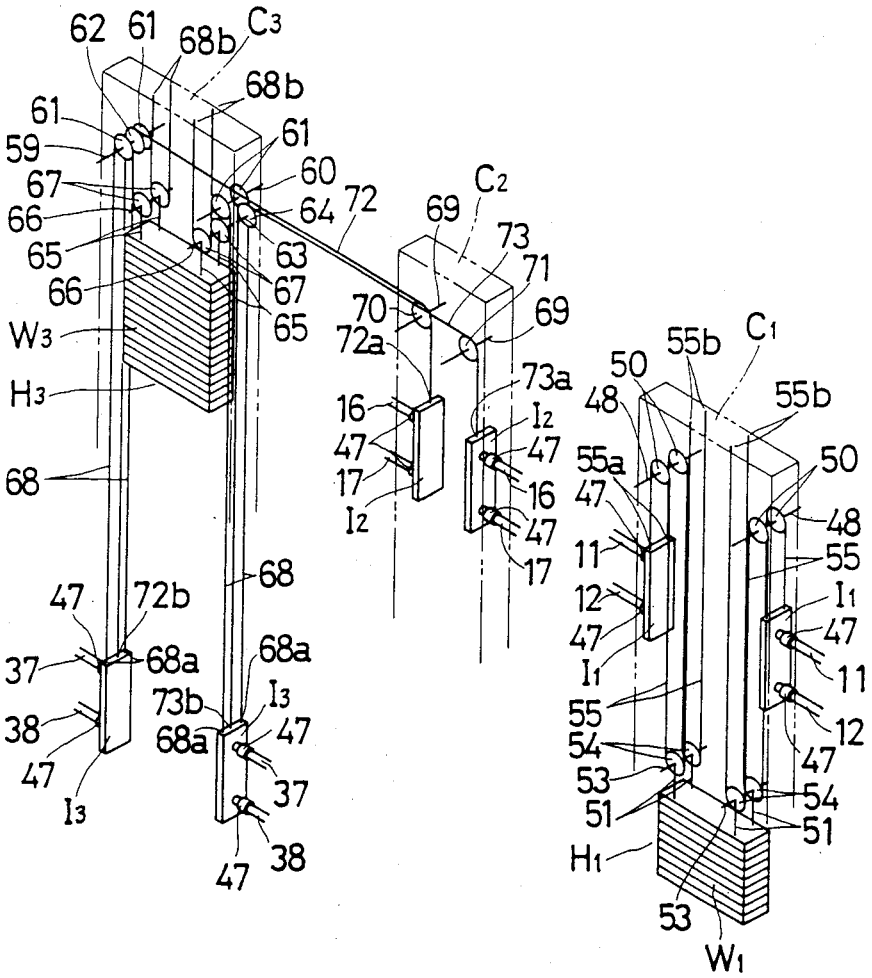
FIG. 7 shows inner structures of the central guide post (i.e., a guide post of the stage unit of the invention), of a side guide post, and of the outermost guide post.

Referring to FIGS. 2 and 7, the balancer $H_1$ provided in the guide post includes a counterweight $W_1$ located in the inner chamber 1 of the post. The counterweight $W_1$ comprises a plurality of horizontal weight plates 58. The plates 58 are supported by a pair of front vertical bars 56 and a pair of rear vertical bars 56. However, the rear vertical bars 56 are not shown in FIG. 2. All the bars 56 extend through the plates 58. The plates 58 are placed on a bottom support plate 57. The lower end portions of the bars 56 extend through the plate 57. The front bars 56 and the rear bars 56 are suspended from a pair of front and rear horizontal support members 52, respectively. Only the front support member 52 is shown in FIG. 2. The front support member 52 is in turn suspended from a pair of front vertical support members 51. Similarly, the rear support member 52 is suspended from a pair of rear vertical support members 51 (not shown). A pin 53 extends through the upper ends of the right-hand front and rear vertical support members 51. Also a pin 53 extends through the upper ends of the left-hand front and rear vertical support members 51. A pair of front and rear vertically-movable sprockets 54 are provided around each pin 53. The sprockets 54 are located inwardly of the vertical support members 51.

A pair of front top plates 49 are fixed to the top of the central guide post. Also, although not shown in FIG. 2, a pair of rear top plates 49 are fixed to the top of the central guide post. A pin 48 extends through the right-hand front and rear top plates 49. Also a pin 48 extends through the left-hand front and rear top plates 49. A pair of front and rear sprockets 50 are provided around the right-hand pin 48, and are located between the right-hand front and rear top plates 49. Also, a pair of front and rear sprockets 50 are provided around the left-hand pin 48, and are located between the left-hand front and rear top plates 49. A first chain 55 is fixed to the front left-hand top plate 49 at an upper end **55*b* thereof. The first chain 55 extends downward and engages the front left-hand vertically-movable sprocket 54. And thence the first chain 55 extends upward and engages the upper, front left-hand sprocket 50 and thence extends downward into the left-hand outer chamber 2 and is fixed at a lower end 55*a* thereof to the rectangular support piece $I_1$ located in the left-hand outer chamber 2**.

A second chain 55 is fixed to the rear left-hand top plate 49 at an upper end **55*b* thereof. The second chain 55 extends downward and engages the rear left-hand vertically-movable sprocket 54. And thence the second chain 55 extends upward and engages the upper, rear left-hand sprocket 50 and thence extends downward into the left-hand outer chamber 2 and is fixed at a lower end 55*a* thereof to the rectangular support piece $I_1$ located in the left-hand outer chamber 2**.

A third chain 55 is fixed to the front right-hand top plate 49 at an upper end **55*b* thereof. The third chain 55 extends downward and engages the front right-hand vertically-movable sprocket 54. And thence the third chain 55 extends upward and engages the upper, front right-hand sprocket 50 and thence extends downward into the right-hand outer chamber 2 and is fixed at a lower end 55*a* thereof to the rectangular support piece $I_1$ located in the right-hand outer chamber 2**.

A fourth chain 55 is fixed to the rear right-hand top plate 49 at an upper end **55*b* thereof. The fourth chain 55 extends downward and engages the rear right-hand vertically-movable sprocket 54. And thence the fourth chain 55 extends upward and engages the upper, rear right-hand sprocket 50 and thence extends downward into the right-hand outer chamber 2 and is fixed at a lower end 55*a* thereof to the rectangular support piece $I_1$ located in the right-hand outer chamber 2**.

When the stage proper is to be folded from a horizontal position on the floor to a vertical position, the geared motors $M_1$ are operated to rotate the motor shafts 19 at a very slow speed, or at a very small reduction gear ratio, illustratively of approximately 1/24,000. Thus, each swing arm member $Y_1$ starts to swing upward about the pivot 22, thereby causing the rear portion of the stage proper $D_1$ to start to move upward. Simultaneously, in the guide post $C_1$, the support pieces $I_1$ start to move upward and the counterweight $W_1$ starts to lower. The lowering of the counterweight $W_1$ facilitates the upward movement of the rear portion of the stage proper.

Thus the wheels 13 associated with the foremost legs 8F move toward the guide post $C_1$ on the floor B while the middle and rearmost legs 8 and 8R move upward away from the floor B without changing the upright positions thereof (FIG. 4). The stage proper thus becomes folded.

While the stage proper is thus being folded, the rods 21 of the swing arm member $Y_1$ slide in the elongate members 20 thereof relative to the members 20 and, hence, the arm member $Y_1$ increases its length.

Figure 5:
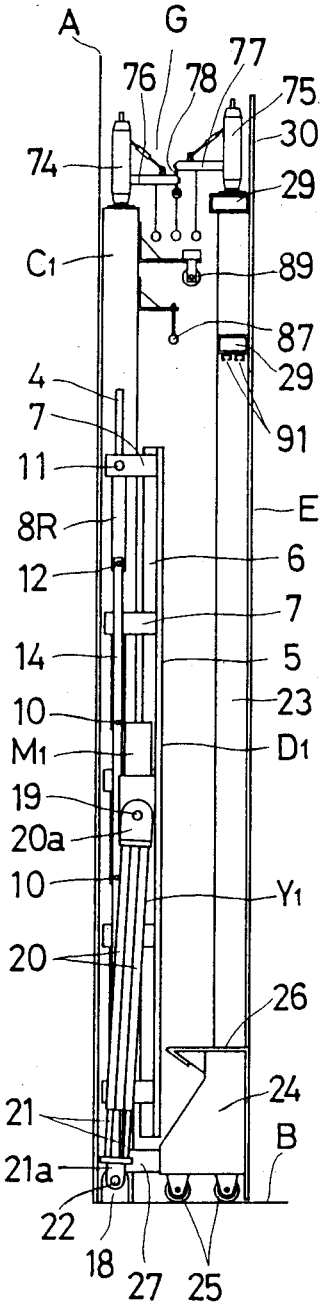
FIG. 5 is a side view in which the stage unit is folded to a vertical position.

Finally the stage proper is folded to an upright position of FIG. 5 adjacent to the guide post.

When the stage proper is to be unfolded to the horizontal position on the floor, the geared motors $M_1$ are operated to rotate the motor shafts 19 in directions opposite to the directions in which the shafts 19 are rotated to fold the stage proper. Thus, each swing arm member $Y_1$ starts to swing downward about the pivot 22, thereby causing the lower portion of the stage proper $D_1$ to start to move forward. Simultaneously, in the guide post $C_1$, the support pieces $I_1$ start to move downward and the counterweight $W_1$ starts to move upward.

Thus, the wheels 13 associated with the foremost legs 8F move forward while the middle and rearmost legs 8 and 8R move downward, maintaining the upright positions thereof, until the stage proper is unfolded to the horizontal position.

Figure 3:
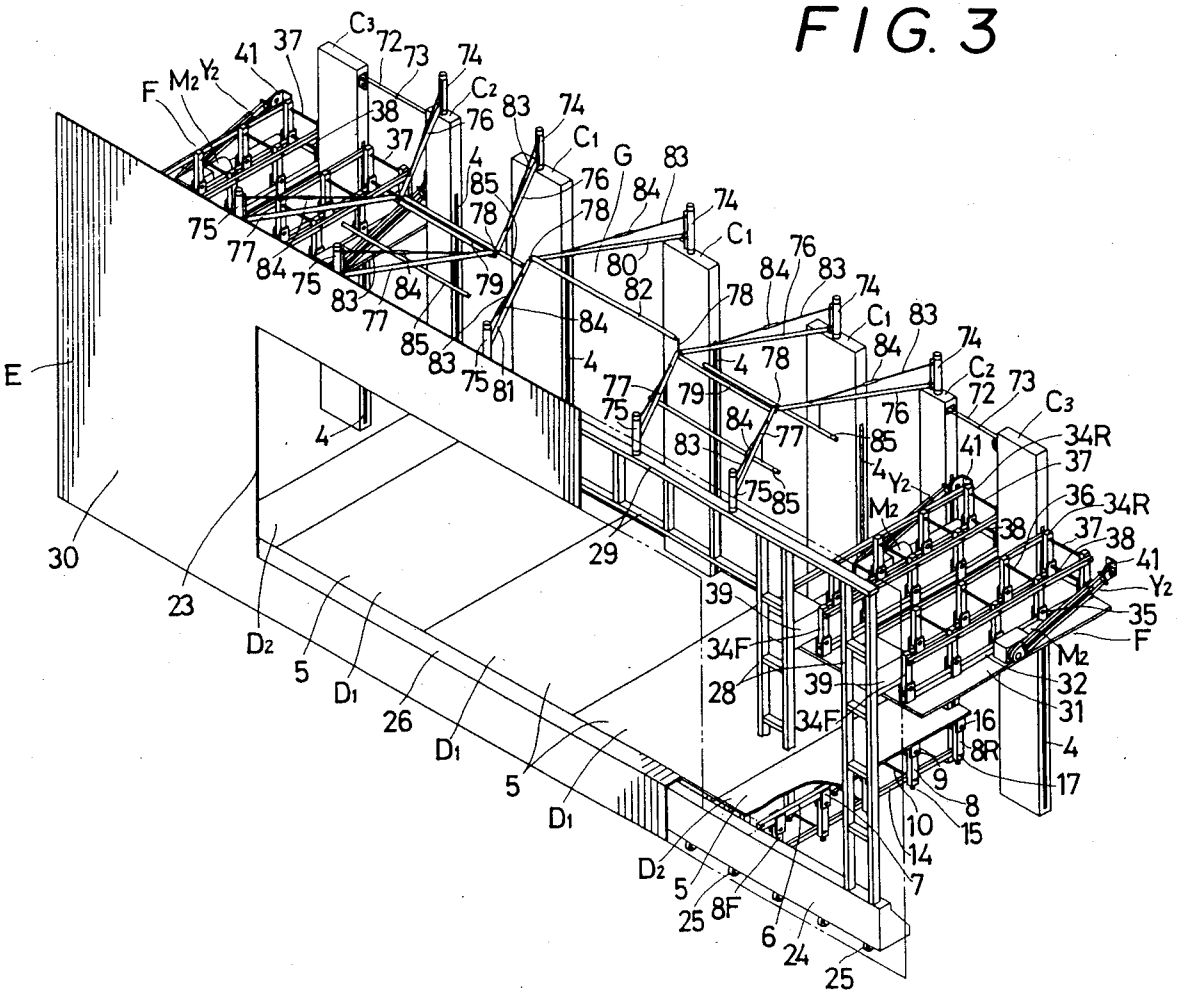
FIG. 3 is a perspective view of a full-size folding stage system with the stage units of the invention.

The stage unit of the invention may be advantageously used as major components of a full-size folding stage system. Such a use of the stage unit is illustrated in FIG. 3. That is, FIG. 3 depicts a full-size folding stage system with a plurality of stage units of the invention. The folding stage system comprises central stage units (i.e., stage units of the invention), side stage units, outermost guide posts, a proscenium wall E and side link mechanisms F. As in the case of each central stage unit, each side stage unit comprises a guide post $C_2$ and a stage proper $D_2$. The guide post $C_2$ includes an enclosure which defines an inner space. Unlike the guide post $C_1$ of the central stage unit, the guide post $C_2$ of the side stage unit has no balancer therein (FIG. 7). Each outermost guide post $C_3$also includes an enclosure which defines an inner space. As in the case of the guide post $C_1$ of the central stage unit, the outermost guide post $C_3$has a balancer $H_3$ therein. As in the case of the central guide post $C_1$, the inner space of the side guide post $C_2$ is generally divided into an inner large chamber and outer small chambers. It is also the case with the outermost guide post $C_3$. A pair of support pieces $I_2$ are located in the outer chambers of the side guide post $C_2$, respectively. Similarly, a pair of support pieces $I_3$ are located in the outer chambers of the outermost guide post $C_3$, respectively. Like the support pieces $I_1$, the support pieces $I_2$ and $I_3$ are vertically movable.

Also, as in the case of the central guide post $C_1$, the side guide post has a pair of vertical grooves 4 in the side walls thereof, respectively, which extend through the entire thicknesses of the side walls. It is also the case with the outermost guide post $C_3$.

The stage proper $D_2$ of the side stage unit has substantially the same construction as the stage proper $D_1$ of the central stage unit, except that the stage proper $D_2$ has no geared motors or components related thereto. Other differences are that the stage proper $D_2$ has only one pair of beams 6 fixed to the bottom of the platform 5 and that in the stage proper $D_2$ lower beams 14 are connected to the insides of the support legs.

Referring to FIGS. 3 and 4, the construction of each side link mechanism F is substantially the same as that which would be obtained if the stage proper $D_1$ were turned upside down. Each side link mechanism F includes a rectangular plate 31 corresponding to the platform 5 of the stage proper $D_1$. Two pairs of opposed beams 32 are fixed to the upper surface of the plate 31. A row of five uprights 34 are connected to each beam 32 by means of connecting members 33. The foremost upright 34F and the three middle uprights 34 of each row are connected to the associated connecting members 33 by means of pivotal pins 35, respectively. Likewise, the rearmost upright 34R of each row is connected to the associated connecting members 33 by a pivotal rod 38. However, the pivotal rod 38 extends toward the opposed, partnered rearmost upright 34R and also connects this partnered rearmost upright 34R to the connecting members 33 associated therewith. Thus the pivotal rod 38 connects the opposed, partnered rearmost uprights 34R.

Also, all the uprights 34F, 34 and 34R of each row are connected at the upper portions thereof to the opposed, partnered uprights of the opposed row by means of upper connecting rods. The upper connecting rods which connect the partnered foremost and three middle uprights 34F and 34 are designated by reference numeral 36 (FIG. 4). The upper connecting rod which connects the partnered rearmost uprights 34R is designated by reference numeral 37. In addition, the opposed end portions of each connecting rod extend through and project from the associated uprights, and connect opposed upper beams 40 pivotally to the opposed rows of the uprights.

The inner end portions of the rods 37 and 38 project toward the associated outermost guide post $C_3$, and are fixedly received by rod supports 47 which project outwardly from the outer surface of the support piece $I_3$ located in one of the opposed outer chambers 2 of the associated guide post (FIG. 7).

A pair of boxes 39 are associated with the two pairs of the rows of the uprights (FIGS. 3 and 4). Each box 39 has a front surface fixed to the inner surface of one of the side vertical ladder-shaped members of the proscenium wall E. The rear portion of the box 39 is located between the partnered, opposed foremost uprights 34F. The foremost rod 36 connecting the partnered, opposed foremost uprights 34F extends through the top of the rear portion of the box 39 between the opposed foremost uprights 34F. The rear portion of the box 39 is thus supported by the foremost connecting rod 36.

Like the balancer $H_1$ in each central guide post $C_1$, the balancer $H_3$ in each outermost guide post $C_3$ includes a counterweight $W_3$ located in the inner chamber 1 of the post (FIG. 7). The counterweight $W_3$ comprises a plurality of horizontal weight plates. Although not shown, the construction supporting these weight plates is the same as the construction supporting the weight plates 58 of the foregoing balancer $H_1$. As with the balancer $H_1$, a pair of right-hand front and rear sprockets 67 and a pair of left-hand front and rear sprockets 67 are provided. The construction supporting these sprockets 67 is the same as the construction supporting the corresponding sprockets 54 of the balancer $H_1$.

Three aligned sprockets 61, 62 and 61 are provided in proximity to the top of the guide post $C_3$. These sprockets 61, 62 and 61 are located on the left side of the inner space of the guide post. The sprockets 61, 62 and 61 are supported by a pin 59 which extends therethrough. Also, two aligned sprockets 61 and 61 are provided at the same level as the sprockets 61, 62 and 61. These sprockets 61 and 61 are located on the right side of the inner space of the guide post. In addition, a sprocket 64 is provided at the same level as the sprockets 61 and 61. This sprocket 64 is located nearer to the right-hand side wall of the guide post $C_3$ than the sprockets 61, and is positioned between the sprockets 61 and 61 as viewed from the direction of either side wall of the post. The sprockets 61 and 61 are supported by a pin 60 which extends therethrough. The sprocket 64 is supported by a pin 63 which extends therethrough.

A first chain 68 is fixed to the top of the guide post $C_3$ (to be more exact, a part corresponding to the top plate 49 of the balancer $H_1$) at an upper end **68*b* thereof. The first chain 68 extends downward and engages the front left-hand vertically-movable sprocket 67. And thence the first chain 68 extends upward and engages the upper, left-hand foremost sprocket 61 and thence extends downward into the left-hand outer chamber 2 and is fixed at a lower end 68*a* thereof to the rectangular support piece $I_3$ located in the left-hand outer chamber 2**.

A second chain 72 is fixed at one end **72*b* thereof to the support piece $I_3$ in the left-hand outer chamber 2. The second chain 72 extends upward and engages the upper, left-hand middle sprocket 62. And thence the second chain 72 extends horizontally to the right and projects outwardly from an opening of the inner side wall of the guide post and enters the adjacent side guide post $C_2$ through an opening of the opposed side wall of the adjacent side guide post. In this side guide post the second chain 72 engages a left-hand sprocket 70 provided therein, and extends downward and is fixed at an opposed end 72*a* thereof to the support piece $I_2$ located in the left-hand outer chamber 2** of the side guide post.

A third chain 68 is fixed to the top of the guide post $C_3$ (to be more exact, a part corresponding to the top plate 49 of the balancer $H_1$) at an upper end **68*b* thereof. The third chain 68 extends downward and engages the rear left-hand vertically-movable sprocket 67. And thence the third chain 68 extends upward and engages the upper, left-hand rearmost sprocket 61 and thence extends downward into the left-hand outer chamber 2 and is fixed at a lower end 68*a* thereof to the support piece $I_3$ located in the left-hand outer chamber 2**.

A fourth chain 68 is fixed to the top (to be more exact, a part corresponding to the top plate 49) of the guide post $C_3$ at an upper end **68*b* thereof. The fourth chain 68 extends downward and engages the front right-hand vertically-movable sprocket 67. And thence the fourth chain 68 extends upward and engages the front one 61 of the upper two right-hand aligned sprockets and thence extends downward into the right-hand outer chamber 2 and is fixed at a lower end 68*a* thereof to the support piece $I_3$ located in the right-hand outer chamber 2**.

A fifth chain 73 is fixed at one end 73b thereof to the support piece $I_3$ in the right-hand outer chamber 2. The fifth chain 73 extends upward and engages the upper rightmost sprocket 64. And thence the fifth chain 73 extends horizontally to the right through the foregoing opening of the inner side wall of the guide post, and enters the adjacent side guide post $C_2$ through the foregoing opening of the opposed side wall of the guide post $C_2$. In this guide post the fifth chain 73 further extends to the right and engages a right-hand sprocket 71 provided therein and extends downward and is fixed at an opposed end thereof to the support piece $I_2$ located in the right-hand outer chamber 2 of the guide post $C_2$.

A sixth chain 68 is fixed to the top (to be more exact, a part corresponding to the top plate 49) of the guide post $C_3$ at an upper end 68b thereof. The sixth chain 68 extends downward and engages the rear right-hand vertically-movable sprocket 67. And thence the sixth chain 68 extends upward and engages the rear one of the two upper right-hand aligned sprockets 61 and thence extends downward into the right-hand outer chamber 2 and is fixed at a lower end 68a thereof to the support piece $I_3$ located in the right-hand outer chamber 2.

The foregoing description of the balancer $H_3$ has been made with reference to FIG. 7. That is, the foregoing description has been made of the balancer $H_3$ provided in the left-hand outermost guide post $C_3$. However, the construction of the balancer $H_3$ in the right-hand outermost guide post $C_3$ is the same as the construction of the balancer $H_3$ in the left-hand outermost guide post $C_3$ except that the sprockets of the former balancer $H_3$ corresponding to the left-hand three aligned sprockets 61, 62 and 61 of the latter balancer $H_3$ are located on the right side in the guide post and the sprockets of the former balancer corresponding to the right-hand two aligned sprockets 61 and sprocket 64 of the latter balancer are located on the left side in the guide post.

Since the chains 72 and 73 connect the support pieces $I_3$ in the outermost guide post and the support pieces $I_2$ in the adjacent side guide post, the support pieces $I_2$ are raised when the support pieces $I_3$ are lowered, and vice versa. This mechanism enables the stage proper $D_2$ to be folded or unfolded simultaneously with the side link mechanism. In other words, the operation of the stage proper $D_2$ depends entirely upon that of the side link mechanism. However, it will be appreciated that the rear end of the side link mechanism is lowered when the side link mechanism is folded, while the rear end of the stage proper $D_2$ is raised when the stage proper $D_2$ is folded.

The proscenium wall E comprises an inner construction and an outer covering 30. The inner construction includes a base 24, two pairs of side vertical ladder-shaped members 28 and an upper horizontal ladder-shaped member 29. The outer covering 30 covers not only the entire front of the inner construction but also the top of the base 24. The portion of the outer covering 30 which covers the top of the base 24 is level with the platforms forms 5 of the stages proper $D_1$ and $D_2$.

The base 24 is provided with wheels 25 at the bottom thereof. The wheels 25 enables the proscenium wall E to be moved toward or away from the guide posts.

The lower portion of the base 24 is connected to the foremost support legs 8F of each of the five stages proper $D_1$ and $D_2$ by means of connecting means 27 (FIGS. 2, 3 and 5).

The outer covering 30 may be formed of, for example, a decorative laminated sheet.

Referring to FIGS. 3 and 4, each side link mechanism F includes a pair of geared motors $M_2$ fixed on the upper surface of the plate 31. These motors are located with the two pairs of the rows of the uprights between. Each motor $M_2$ is rotatable in either of opposed directions. Each motor $M_2$ has an outwardly-projecting output shaft 42. The shaft 42 has a torque limiter (not shown) therein. Reference numeral 43 designates a pair of elongate, hollow rectangular members which are formed integrally with each other. The elongate members 43 are connected to the output shaft 42 by means of a connecting means 43a which is fixed to the shaft 19. A pair of rods 44 are received in the respective elongate members 43. One end of each rod 43 is fixed to a connecting means 44a. The connecting means 44a is connected to a support means 41 by a pivot 45. The support means 41 is fixed to the wall A.

Each rod 44 has a free end in the associated elongate member 43, and is slidable therein along the length thereof.

The elongate members 43 and the slidable rods 44 constitute a swing arm member $Y_2$. The motors $M_2$ and the swing arm members $Y_2$ in turn constitute a mechanism for folding the side link mechanism F to an upright position (FIG. 6) which is immediately in front of the associated outermost guide post $C_3$ or unfolding it to the horizontal position of FIG. 2.

When the foregoing folding mechanism folds or unfolds the side link mechanism F, the rods 44 slide in the respective elongate members 43 and, thus, the distance between the motor shaft 42 and the pivot 45 is varied.

Thus the foregoing folding mechanism for the side link mechanism is essentially the same as the folding mechanism for the stage proper $D_1$ in construction.

The central link mechanism G is located above the stages proper. The central link mechanism G comprises poles, connecting rods and means (bars) for supporting the connecting rods.

Five rear poles 74 project from the tops of the five guide posts $C_1$ and $C_2$, respectively. The rightmost rear pole 74 will be called a "first rear pole", and the other rear poles 74 will be called accordingly. Correspondingly, five front poles 75 project from the top of the horizontal ladder-shaped member 29 of the proscenium wall E, and are opposed to the respective five poles 74 on the guide posts. The rightmost front pole 75 will be called a "first front pole", and the other front poles 75 will be called accordingly. All the front and rear poles 75 and 74 are rotatable in horizontal planes.

A pair of first and second horizontal slant rods 77 and 76 are fixed at outer ends thereof to the first front pole 75 and to the first rear pole 74, respectively. The first and second slant rods 77 and 76 extend inwardly, and are connected to a first common vertical pivot 78 at the inner ends thereof.

Similarly, a pair of third and fourth horizontal slant rods 77 and 76 are fixed at outer ends thereof to the second front pole 75 and to the second rear pole 74, respectively. The third and fourth slant rods 77 and 76 extend inwardly, and are connected to a second common vertical pivot 78 at the inner ends thereof. As clearly illustrated in FIG. 3, the third and fourth rods 77 and 76 slant in the same directions as the first and second slant rods 77 and 76.

The first and second pivots 78 are connected to each other by means of a first horizontal transverse rod 79.

A pair of central horizontal slant rods 81 and 80 are fixed at outer ends thereof to the third front pole 75 and to the third rear pole 74, respectively. The central slant rods 81 and 80 extend inwardly, and are connected to a central common vertical pivot 78 at the inner ends thereof. The central slant rods 81 and 80 slant in the same directions as the first to fourth slant rods 77 and 76.

The central pivot 78 and the second pivot 78 are connected to each other by means of a central horizontal transverse rod 82. The second pivot 78 is longer than the first pivot 78, and the top of the second pivot 78 is at a higher level than the top of the first pivot 78. One end of the central transverse rod 82 is connected to the top of the second pivot 78. And the entire central transverse rod 82 is located at a higher level than the first transverse rod 79.

A pair of fifth and sixth horizontal slant rods 77 and 76 are fixed at outer ends thereof to the fourth front pole 75 and to the fourth rear pole 74, respectively. The fifth and sixth slant rods 77 and 76 extend inwardly, and are connected to a third common vertical pivot 78 at the inner ends thereof. As clearly illustrated in FIG. 3, the fifth and six rods 77 and 76 slant in the directions opposite to the first to fourth slant rods.

Similarly, a pair of seventh and eighth horizontal slant rods 77 and 76 are fixed at outer ends thereof to the fifth front pole 75 and to the fifth rear pole 74, respectively. The seventh and eighth slant rods 77 and 76 extend inwardly, and are connected to a fourth common vertical pivot 78 at the inner ends thereof. The seventh and eighth rods 77 and 76 slant in the same directions as the fifth and sixth slant rods 77 and 76.

The third and fourth pivots 78 are connected to each other by means of a second horizontal transverse rod 79.

A support bar 83 is fixed to each of the front and rear poles 75 and 74 at an outer end thereof (FIGS. 3 and 4). The support bar 83 is inclined inwardly and has an inner end fixed to the inner end portion of the associated slant rod. The bar 83 thus serves to support the associated slant rod from above. The support bar 83 has a turnbuckle 84.

Figure 6:
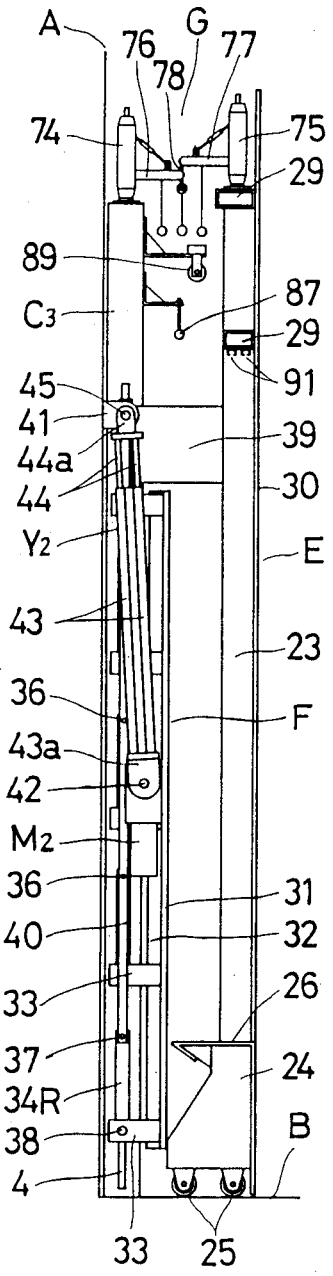
FIG. 6 is a side view in which a side link mechanism is folded to a vertical position.

The top of the horizontal ladder-shaped member 29 of the proscenium wall E is slightly at a higher level than the tops of the guide posts, and the front slant rods 77 and the support bars 83 associated therewith are at slightly higher levels than the rear corresponding parts 76 and 83 (FIGS. 5 and 6).

The second transverse rod 79 is at the same level as the first transverse rod 79. However the central transverse rod 82 is at a higher level than the first and second transverse rods 79. Also, the central slant rods 81 and 80 are at higher levels than the first to eighth slant rods 77 and 76.

When the stages proper are folded, all the slant rods 76, 77, 80 and 81 are also folded. Precisely speaking, when the stages proper are folded, all the slant rods turn on the vertical pivots 78 in horizontal planes, with the outer end of each slant rod moving toward the outer end of the partnered slant rod. When the slant rods are thus folded, the central rods 80, 81 and 82 do not go against the side rods 76, 77 and 79 since the central rods are at higher levels than the side rods as mentioned above.

Two parallel battens 85 are suspended from the first and third slant rods 77 and from the second and fourth slant rods 76, respectively. Likewise, two parallel battens 85 are suspended from the fifth and seventh slant rods 77, respectively. Tormentors (not shown) may be hung from the respective battens 85. Although omitted from FIG. 3, a single continuous central batten 86 is suspended from the three transverse rods 79 and 82. The central batten 86 is shown in FIG. 4. The central batten 86 is parallel to the battens 85. A teaser (not shown)

As shown in FIG. 4, brackets 88 are fixed to the upper portions of the guide posts $C_1$ and $C_2$, respectively. A batten 87 is suspended from each bracket 88 (FIG. 4). The battens 87 are parallel to the inner surfaces of the guide posts. A scenery curtain (not shown) may be hung from the battens 87.

Also, brackets 90 are fixed to the upper portions of the central guide posts $C_1$, respectively. The brackets 90 are located above the brackets 88. A batten 89 is suspended from each bracket 90. The battens 89 are also parallel to the inner surfaces of the guide posts $C_1$. A screen (not shown) may be hung from the battens 89. Also, flags (not shown) may be supported by the battens 89.

The horizontal ladder-shaped member 29 of the proscenium wall E is provided at the lower surface thereof with rails 91 which extend along the length of the member 29. An act curtain (not shown) may be hung from the rails 91. In addition, a teaser and a pair of legs (not shown) may be hung from the rails 91.

When the stage system is to be folded from its position of FIG. 3 to its position of FIGS. 5 and 6, the geared motors $M_1$ of the central stage units and the geared motors $M_2$ of the side link mechanisms F are operated substantially simultaneously. Then the motor shafts 19 and 42 start to rotate at a very slow speed, or at a very small reduction gear ratio, illustratively of approximately 1/24,000.

Each swing arm member $Y_1$ starts to swing upward about the pivot 22, thereby causing the rear portion of the stage proper $D_1$ to start to move upward. Simultaneously, in the guide post $C_1$, the support pieces $I_1$ start to move upward and the counterweight $W_1$ starts to lower. The lowering of the counterweight $W_1$ facilitates the upward movement of the rear portion of the stage proper.

Thus the wheels 13 associated with the foremost legs 8F move toward the guide post $C_1$ on the floor B while the middle and rearmost legs 8 and 8R move upward away from the floor B without changing the upright positions thereof (FIG. 4). The stage proper $D_1$ of the central stage unit thus becomes folded.

While the central stage proper $D_1$ is thus being folded, the rods 21 of the swing arm member $Y_1$ slide in the elongate members 20 thereof relative to the members 20 and, hence, the arm member $Y_1$ increases its length.

Finally the stage proper $D_1$ is folded to an upright position of FIG. 5 adjacent to the guide post $C_1$.

On the other hand, the rotation of each motor shaft 42 causes the swing arm member $Y_2$ to swing downward about the pivot 45, thereby lowering the rear portion of the side link mechanism F. Simultaneously, in the guide post $C_3$, the support pieces $I_3$ move downward while the counterweight $W_3$ moves upward. The uprights 34F, 34 and 34R move toward the guide post $C_3$ without changing the upright positions thereof. Finally the side link mechanism F is folded to an upright position of FIG. 6 adjacent to the guide post. While the side link mechanism is thus being folded, the rods 44 of the swing arm member $Y_2$ slide in the elongate members 43 thereof relative to the members 43 and, hence, the arm member $Y_2$ increases its length.

Since the stage proper $D_2$ of the side stage unit is connected to the side link mechanism F by means of the support pieces $I_2$, the chains 72 and 73 and the support pieces $I_3$, the stage proper $D_2$ is folded in the same manner as the stage proper $D_1$ simultaneously when the side link mechanism is folded.

Since the lower portion of the proscenium wall E is connected to all the stages proper by the connecting means 27, the lower portion of the wall E is moved toward the guide posts simultaneously when the stages proper are folded. Likewise, since the upper side portions of the wall E are connected to the side link mechanisms F by the boxes 39, the upper portion of the wall E is moved toward the guide posts simultaneously when the side link mechanisms are folded. Thus, the entire wall E is moved uniformly toward the guide posts simultaneously with the folding of the stages proper and the side link mechanisms. As a result, the proscenium wall E is stored in a position which is in close proximity to the guide posts (FIGS. 5 and 6). The wall E maintains its vertical position at all times.

Also, when the stages proper and the side link mechanisms are folded, all the slant rods 76, 77, 80 and 81 of the central link mechanism G are folded.

Thus, the proscenium wall, the stages proper, the side link mechanisms and the central link mechanism are all compactly folded, or stored, to a position adjacent to the guide posts.

It will be appreciated that if curtains are hung from the battens 85, 86, 87 and 89 and from the rails 91, the foregoing constructions can be stored without removing the curtains.

When the stage system is to be unfolded to the position of FIG. 3, the geared motors $M_1$ of the central stage unit and the geared motors $M_2$ of the side link mechanisms F are operated to rotate the motor shafts 19 and 42 in directions opposite to the directions in which the shafts are rotated to fold the stage system.

Each swing arm member $Y_1$ starts to swing downward about the pivot 22, thereby causing the lower portion of the stages proper to start to move forward. Simultaneously, in the guide post $C_1$, the support pieces $I_1$ start to move downward and the counterweight $W_1$ starts to move upward.

Thus the wheels 13 associated with the foremost legs 8F move forward while the middle and rearmost legs 8 and 8R move downward, maintaining the upright positions thereof, until the stage proper $D_1$ is unfolded to the horizontal position of FIG. 3.

On the other hand, the rotation of each motor shaft 42 causes the swing arm member $Y_2$ to swing upward about the pivot 45, thereby raising the lower portion of the side link mechanism F. Simultaneously, in the guide post $C_3$, the support pieces $I_3$ move upward while the counterweight $W_3$ moves downward. The uprights 34F, 34 and 34R move forward while maintaining the upright positions thereof. Finally the side link mechanism F is unfolded to the horizontal position of FIG. 3. Simultaneously when the side link mechanism F is thus unfolded, the stage proper $D_2$ is unfolded in the same manner as the stage proper $D_1$ While the stages proper and the side link mechanisms are unfolded, the central link mechanism G is also unfolded and the proscenium wall E moves forward.

What is claimed is:

1. A folding stage unit comprising (a) a guide post fixed to an indoor or outdoor support wall structure and having (i) an inner space generally divided into an inner chamber and outer chambers, (ii) vertical grooves provided in opposed side walls of the guide post which make said outer chambers communicate with the outside of the guide post, (iii) a pair of vertically-movable support means provided in said outer chambers, respectively, (iv) a vertically-movable balancer provided in said inner chamber, and (v) means provided in said inner space for connecting said support means and said balancer for opposite vertical movements (b) a stage proper including (i) a platform, (ii) a platform supporting structure with plural support legs which are pivotally connected to a bottom of said platform, and (iii) wheels provided in conjunction with respective foremost ones of said support legs to enable a front end portion of the stage proper to move smoothly toward or away from the guide post on a floor, (c) means for connecting a rear portion of said platform supporting structure to said support means through said grooves so that a rear portion of the stage proper can be moved along the guide post, (d) a pair of opposed operating mechanisms connected to said platform supporting structure for folding the stage proper from a horizontal position on the floor to a vertical position adjacent to the guide post or unfolding the stage proper from the vertical position to the horizontal position, (e) each said operating mechanism including (i) a geared motor fixed to said platform supporting structure at a substantial middle of the distance between front and rear ends of the stage proper and having an output shaft rotatable in either of opposed directions and (ii) an extensible swing arm member having one end fixed to said output shaft, and (f) means for pivotally connecting an opposed end of said swing arm member to a portion chosen between a portion of the floor which is in close proximity to said support wall structure and a lower end portion on said support wall structure.

2. A folding stage unit in accordance with claim 1 wherein said swing arm member includes (i) a pair of elongate hollow members and (ii) rods having free end portions received in the respective elongate members in such a manner that said free end portions may slide along the lengths of the respective elongate members.

* * * * *